US005449334A

United States Patent [19]

Kingsbury

[11] Patent Number: 5,449,334

[45] Date of Patent: Sep. 12, 1995

[54] ROTATABLE EXERCISE APPARATUS

[76] Inventor: Doug Kingsbury, P.O. Box 980305, Houston, Tex. 77098

[21] Appl. No.: 216,478

[22] Filed: Mar. 22, 1994

[51] Int. Cl.[6] ..... A63B 22/06; A63B 21/12

[52] U.S. Cl. ..... 482/57; 482/61; 482/62; 482/63; 601/26; 601/36

[58] Field of Search ..... 482/16, 57, 61, 62, 482/66, 63; 472/16, 63; 601/26, 36, 24

[56] References Cited

U.S. PATENT DOCUMENTS

| | | | |
|---|---|---|---|
| 597,843 | 1/1898 | French . | |
| 2,144,206 | 1/1939 | Thompson | 482/57 |
| 2,403,593 | 7/1946 | Franklin . | |
| 3,127,169 | 3/1964 | Guihan . | |
| 3,298,685 | 1/1967 | Williams | 472/16 |
| 3,519,268 | 7/1970 | McQueen . | |
| 3,662,747 | 5/1972 | Williams . | |
| 3,972,527 | 8/1976 | Bacon . | |
| 4,147,343 | 4/1979 | Hyde et al. . | |
| 5,232,422 | 8/1993 | Bishop, Jr. | 482/57 |

*Primary Examiner*—Jerome W. Donnelly
*Attorney, Agent, or Firm*—David M. O'Brian

[57] ABSTRACT

A rotatable exercise apparatus for rotating a user in such a manner that the user's center of gravity is offset with respect to the user's center of rotation, while simultaneously exercising the user's arms, legs, stomach, back, side and neck. The rotatable exercise apparatus generally comprises a rotatable frame having an outwardly facing user support for offsetting the user's center of gravity from the user's center of rotation, a frame support structure, and a means for rotating the frame. The rotatable exercise apparatus provides a strenuous, low impact, complete physical work out which simulates the exercise and exertion which may be experienced by the human body, while participating in sailing-type activities.

12 Claims, 5 Drawing Sheets

ROTATABLE EXERCISE APPARATUS

FIELD OF THE INVENTION

The present invention relates generally to a rotatable exercise apparatus which rotates a user while providing a strenuous form of exercise to the user. Specifically, the present invention relates to a rotatable exercise apparatus which rotates an outwardly facing user while offsetting the user's center of gravity from the user's center of rotation and simultaneously providing strenuous exercise to the user's arms, legs, stomach, neck, back and sides to achieve a low impact, complete physical exercise work out.

BACKGROUND OF THE INVENTION

The promotion of personal health and fitness has always been of particular interest to the general public. Improving and maintaining personal health and fitness has become one of the fastest growing industries in the United States, in terms of new products and services. While calisthenics, walking and running have always been considered essential in maintaining fitness, a variety of fitness devices have been developed to more efficiently shape and tone human muscle. The most common fitness devices include resistance exercise equipment and free weights.

In the known rotation devices, the user is rotated in such a manner that the user's center of gravity is positioned at or near the user's center of rotation. Where the user's center of gravity is positioned generally at the user's center of rotation, the user is required to expend very little effort to rotate and therefore receives little, if any, exercise benefit. To significantly enhance the exercise benefit from a rotatable exercise device, the device offsets the user's center of gravity from the user's center of rotation.

It is well known that the physical exercise experienced during participation in sailing-type activities is very effective for exercising the participant's arms, upper body, stomach, legs, back, sides and neck. Sailing-type activities such as the grinding of winches, hoisting of sails and the pulling of lines, vigorously exercise the arms and upper body. The legs are exercised by the constant up and down climbing motion, as well as the necessary walking and running, which is required to tend the sails, let out and take up the anchor, fasten and adjust lines, fenders, etc. The muscles of the stomach, back, side and neck are continuously exercised by exerting a constant effort to maintain equilibrium, distribute weight and to keep the participant's body upright. The sailing participant's center of gravity must constantly be in motion, to offset the effects of the rolling and pitching of the boat.

Thus far, however, no single exercise apparatus has been successful in duplicating the physical exercise the human body experiences during participation in sailing-type activities while being rotated in such a manner that the user's center of gravity is offset with respect to the user's center of rotation.

In the present invention, the positioning of a participant in an outward facing manner while being rotated, insures that the participant's center of gravity will be offset with respect to the user's center of rotation, thus providing a strenuous, low impact, complete physical exercise work out.

Heretofore, no single exercise apparatus has been able to simulate a rotational exercise apparatus for rotating the user in such a manner that the user's center of gravity is offset from the user's center of rotation while simultaneously exercising the user's arms, legs, stomach, back, side and neck, wherein said apparatus automatically adjusts the amount of resistance needed according to the user's body weight.

Additionally, no single exercise apparatus has thus far been able to simulate a rotational exercise apparatus for rotating the user in such a manner that the user's center of gravity is offset from the user's center of rotation while simultaneously exercising the user's arms, legs, stomach, back, side and neck, wherein the apparatus can be easily adjusted to increase and decrease resistance and speed of the rotations of the rotatable exercise apparatus.

Moreover, no single exercise apparatus has thus far been able to simulate a rotational exercise apparatus for rotating a user in such a manner that the user's center of gravity is offset from the user's center of rotation while simultaneously exercising the user's arms, legs, stomach, back, side and neck, wherein the means for rotation includes a first pedal means for the user's arms and a second pedal means for the user's legs.

Summarily, no single exercise apparatus has thus far been able to simulate a single rotational exercise apparatus for rotating a user in such a manner that the user's center of gravity is offset from the user's center of rotation while simultaneously exercising the user's arms, legs, stomach, back, side and neck which yields a strenuous, low impact, complete body work out as does the present invention.

SUMMARY OF THE INVENTION

The present invention provides a rotatable exercise apparatus for rotating a user in such a manner that the user's center of gravity is offset from the user's center of rotation while simultaneously exercising the user's arms, legs, stomach, back, side and neck. The rotatable exercise apparatus generally comprises a rotatable frame having an outwardly facing user support for offsetting the user's center of gravity from the user's center of rotation; a frame support structure for elevating and suspending the rotatable frame above the ground; and a means for rotating the frame. The means for rotating the frame include a fixed primary gear engaged to the frame support structure; a multi-geared rotation mechanism for rotating the rotatable frame about the fixed primary gear; a first pedal means and a second pedal means for creating rotational energy to rotate the rotatable frame; and a main drive shaft. The present invention also includes a tension sprocket, a first drive mechanism, and a second drive mechanism for transferring the rotational energy to the rotation mechanism.

The rotatable frame comprises a main linear frame member having a first pivot end and a second peripheral end and one or more secondary frame members. The outwardly facing user support includes an outwardly facing back portion, a seat portion and a restraint means which are mounted to the main frame member to secure the user to said seat and back portion, while facing the user away from the center of rotation. The rotatable frame also includes a linearly extended brace, mounted to the peripheral end of the main frame member, wherein the brace has a first end and a second end. The rotatable frame also includes a bracket means which facilitates the mounting and pivoting of the rotatable frame about the frame support structure. The bracket means includes at least two mounting brackets, wherein each mounting bracket has a bearing means.

The frame support structure is comprised of two side support members, a fixed upper horizontal member and two fixed lower horizontal members. The two side support members each include independent height adjustment means to provide for level operation of the present invention on uneven ground.

The fixed primary gear is mounted to the fixed upper horizontal member of the frame support structure. The fixed primary gear does not rotate but is rigidly affixed to the fixed upper horizontal member such that the first pivot end of the rotatable frame rotates with respect to said fixed primary gear.

The multi-geared rotation mechanism is mounted on the first pivot end of the main frame member and one or more secondary frame members and is comprised of a first and second rotatable shaft, a plurality of bearing means and bearing coupling means, a first driven sprocket, a first and second drive gear and at least one driven gear. The second drive gear of the rotation mechanism mechanically engages the fixed primary gear to effectuate rotation of the rotatable frame about the primary gear. The first and second rotatable shafts are mounted to a plurality of bearing means. The beating means are engaged to a plurality of beating couplings and the bearing couplings are fastened to the frame, using conventional fasteners, such as bolts and nuts.

The first pedal means is designed for exercising the user's arms, and is mounted to the first end of the brace. The first pedal means comprises a second sprocket and two opposite extending, opposing pedals affixed to the second sprocket, formed to comfortably adapt to the user's hands.

The second pedal means is designed for exercising the user's legs, and is mounted to the second end of the brace. The second pedal means comprises a third sprocket and two opposite extending, opposing pedals affixed to the third sprocket, formed to comfortably adapt to the user's legs. The first and second pedal means are provided for creating rotational energy which is used ultimately, to rotate the frame.

The main drive shaft has a first end and a second end and transfers rotational energy created by the first and second pedal means to the rotation mechanism. The main drive shaft is mounted within a bearing means, wherein the bearing means is secured within a coupling means and the coupling means is affixed to the main frame member using a plurality of nuts and bolts.

The first drive mechanism is comprised of a first drive chain, a tension sprocket and a fourth sprocket. The fourth sprocket is mounted to the first end of the main drive shaft. The first chain drive engages the second sprocket of the first pedal means, the third sprocket of the second pedal means, the fourth sprocket and a tension sprocket, and transfers the rotational energy created by the first and second pedal means, to the main drive shaft. The tension sprocket is mounted on the main frame member, proximal to the engagement of the main frame member and the brace. The tension sprocket applies and maintains tension to the first drive mechanism.

The second drive mechanism is comprised of a second drive chain and a fifth sprocket. The fifth sprocket is mounted to the second end of the main drive shaft. The second drive chain engages the first driven sprocket of the rotation mechanism and the fifth sprocket. The second drive mechanism is provided for transferring rotational energy from the main drive shaft to the rotation mechanism, to rotate the rotatable frame about the fixed primary gear.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

DETAILED DESCRIPTION OF THE PREFERRED EMBODIMENT

Figure 1:
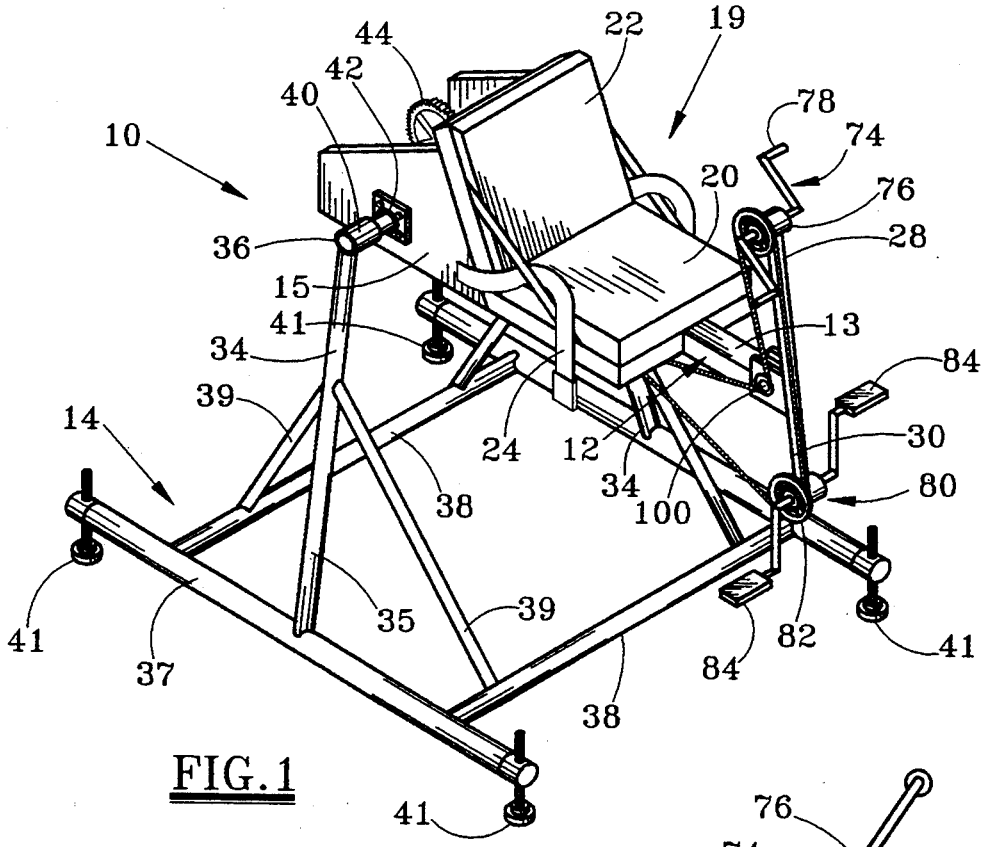
FIG. 1 is perspective view of an embodiment of a rotatable exercise apparatus according to the present invention.

Reference will now be made in detail to the present preferred embodiments of the invention as described in the accompanying drawings.

With reference to FIGS. 1–2 and FIGS. 8–11 wherein like parts are designated by like numerals, a rotatable exercise apparatus 10 according to the present invention has a rotatable frame 12 mounted to a frame support structure 14. The rotatable frame 12 includes a main linear frame member 13. The main frame member 13 has a first pivot end 16 and a second peripheral end 18. The main frame member 13 further includes an outwardly facing user support 19 for offsetting the user's center of gravity CG from the user's center of rotation CR. The user's center of gravity CG is defined as the center of the user's mass. The user's center of gravity CG varies slightly depending upon the positioning of the user. The user's center of rotation CR is defined as the pivot point about which the user and the rotatable frame 12 rotate. The user's center of gravity is a minimum distance from the user's center of rotation CR when the user s center of gravity CG and the user s center of rotation CR are vertically aligned. The user's center of gravity CG is a maximum distance from the user's center of rotation CR when the user's center of gravity CG and the user's center of rotation CR are horizontally aligned.

The user support 19 includes a seat portion 20 and a back portion 22 mounted to said main frame member 13. A restraint means 24 is attached to the rotatable frame 12 to secure the user to said user support 19. The rotatable frame 12 also includes a linearly extended brace 26 engaged to the main frame member 13 proximal to the peripheral end 18 of the rotatable frame 12. The brace 26 has a first end 28 and a second end 30.

Figure 2:
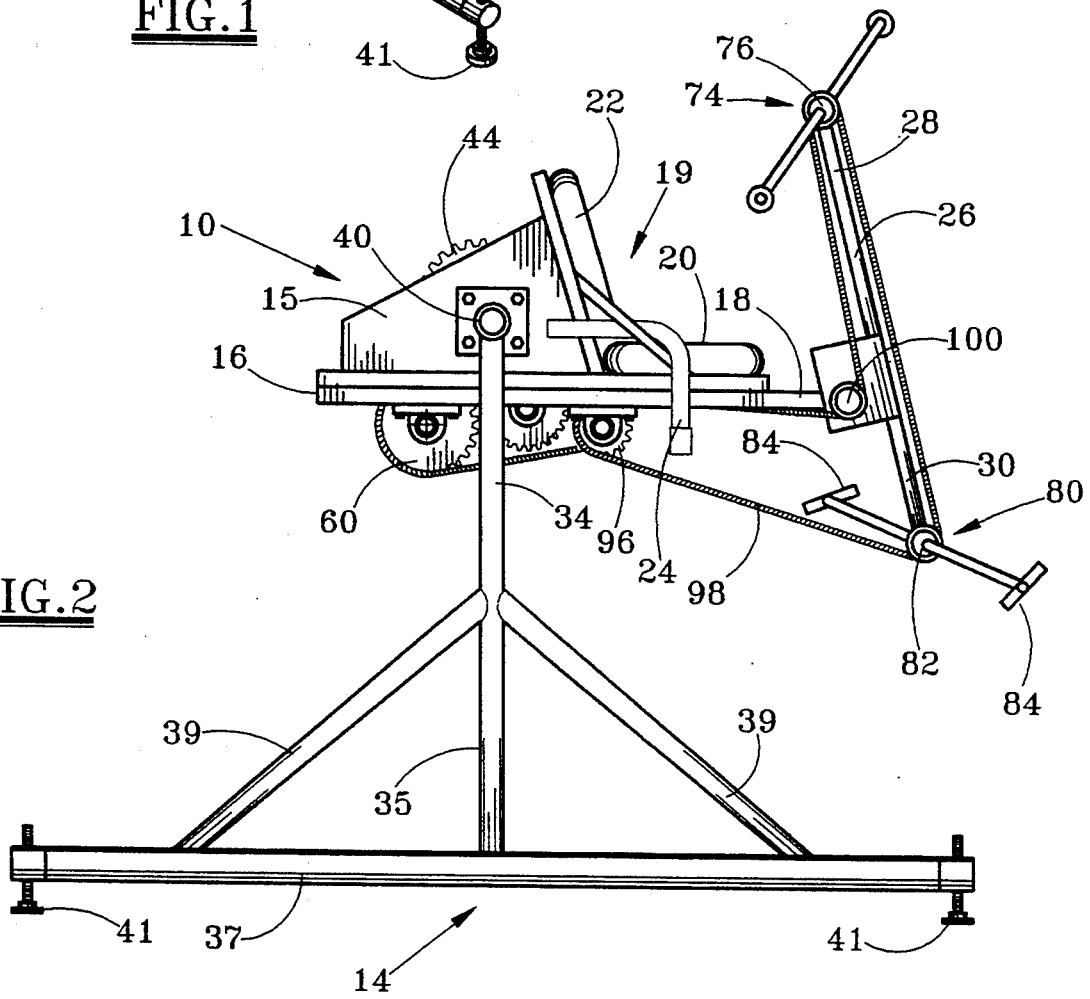
FIG. 2 is a side view of the rotatable exercise apparatus illustrated in FIG. 1.
Figure 5:
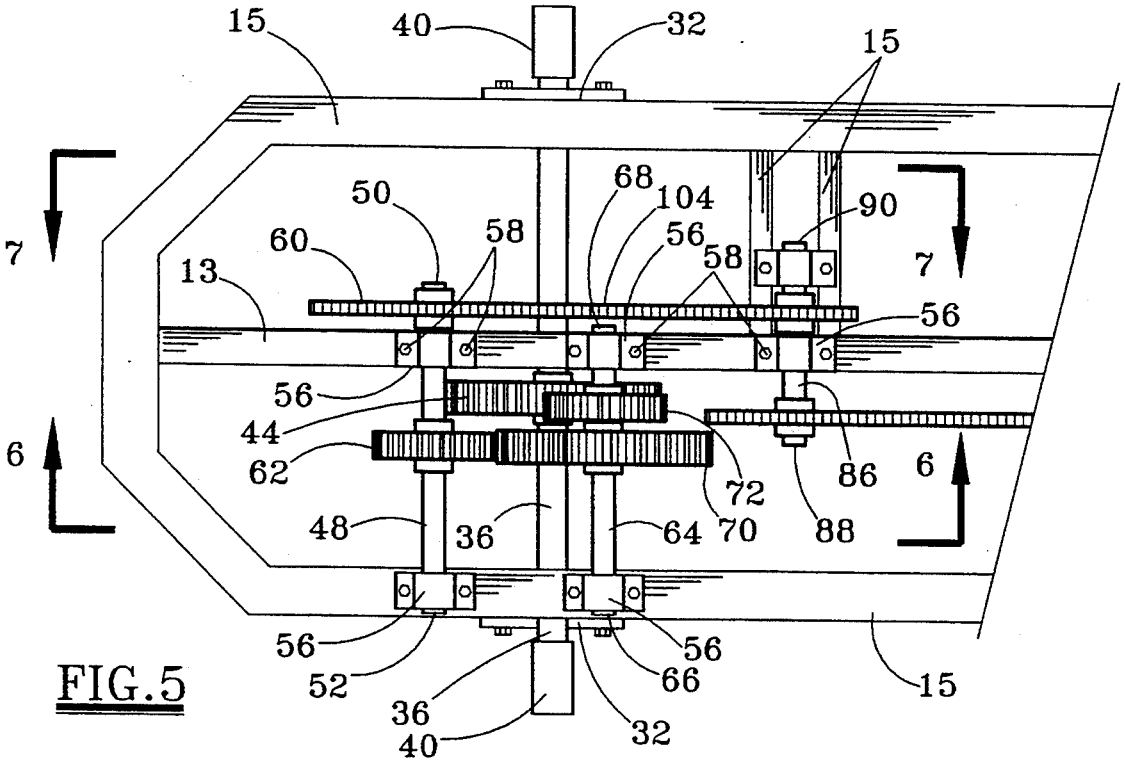
FIG. 5 is a top view of the rotation mechanism of the rotatable exercise apparatus of FIG. 1.
Figure 6:
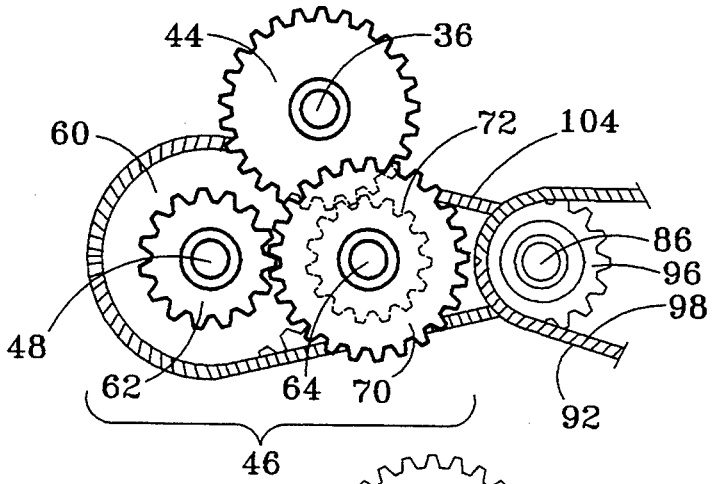
FIG. 6 is a partially cut-away side view of the primary gear, the rotation mechanism, the main drive shaft, the first drive mechanism and the second drive mechanism of the rotatable exercise apparatus of FIG. 1.
Figure 7:
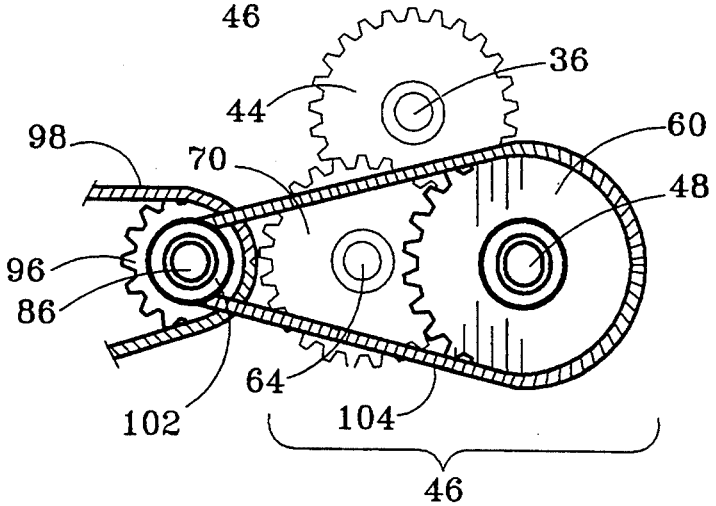
FIG. 7 is a partially cut-away side view of the primary gear, the rotation mechanism, the main drive shaft, the first drive mechanism and the second drive mechanism of the rotatable exercise apparatus of FIG. 1.

With reference now to FIGS. 1–2 and FIG. 5 the rotatable frame 12 additionally includes at least two frame mounting bracket means 32 which affix the rotatable frame 12 to said frame support structure 14.

The frame support structure 14 is comprised of two vertical side support members 34, a fixed upper horizontal member 36 and two fixed lower horizontal members 38, wherein the fixed upper horizontal member 36 and the lower horizontal members 38 are respectively mounted to the two side support members 34. The vertical support members 34, further include a vertical member 35, a horizontal base member 37 which supports the vertical member 35 and two or more diagonal support members 39 which engage and extend between the vertical member 35 and the base member 37. The horizontal base member 37 additionally includes a height adjustment means 41 which allows the present invention to be used on uneven ground. The two vertical side support members 34 also each include a coupling 40 mounted at the upper end of the vertical member 35. The couplings 40 are provided to securely engage the fixed upper horizontal member 36.

The frame mounting bracket means 32, additionally includes a bearing means 42 which engages the fixed upper horizontal member 36 and provides for pivoting motion of the rotatable frame 12 about the axis of the fixed upper horizontal member 36.

Referring now to FIGS. 1–4 and FIGS. 8–11 the fixed upper horizontal member 36 also includes a fixed primary gear 44 mounted laterally thereto. The center of rotation CR is generally located at the center of fixed primary gear 44 and denotes the axis about which the rotatable frame 12 rotates.

Figure 3:
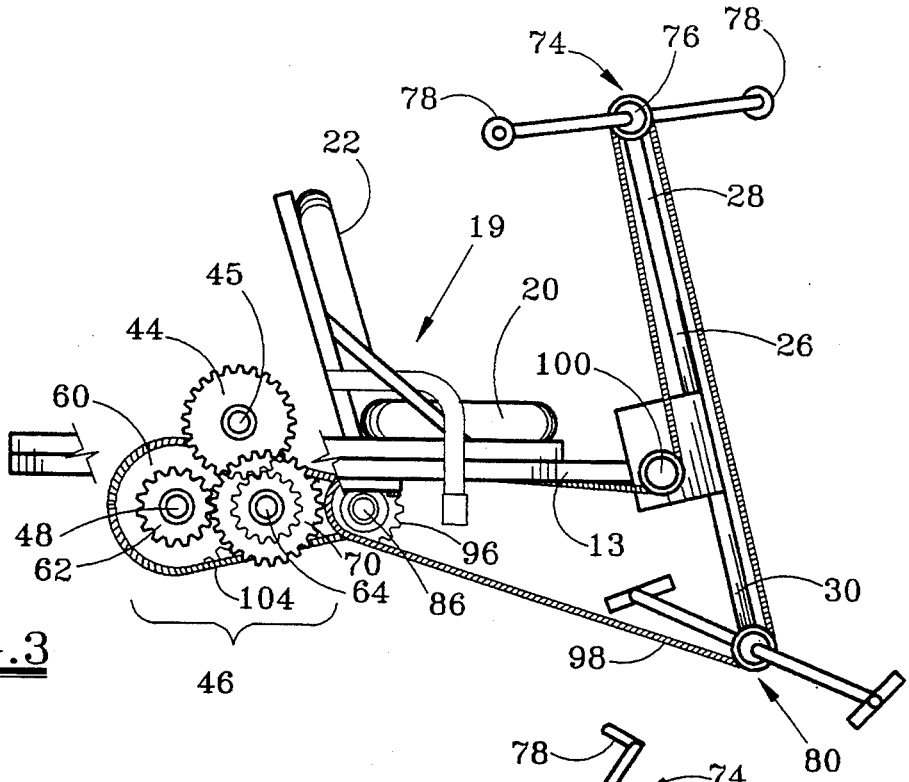
FIG. 3 is a partial cut-away, side view of the rotatable exercise apparatus of FIG. 2, wherein the frame support structure has been removed and the rotation mechanism is displayed in more detail.
Figure 4:
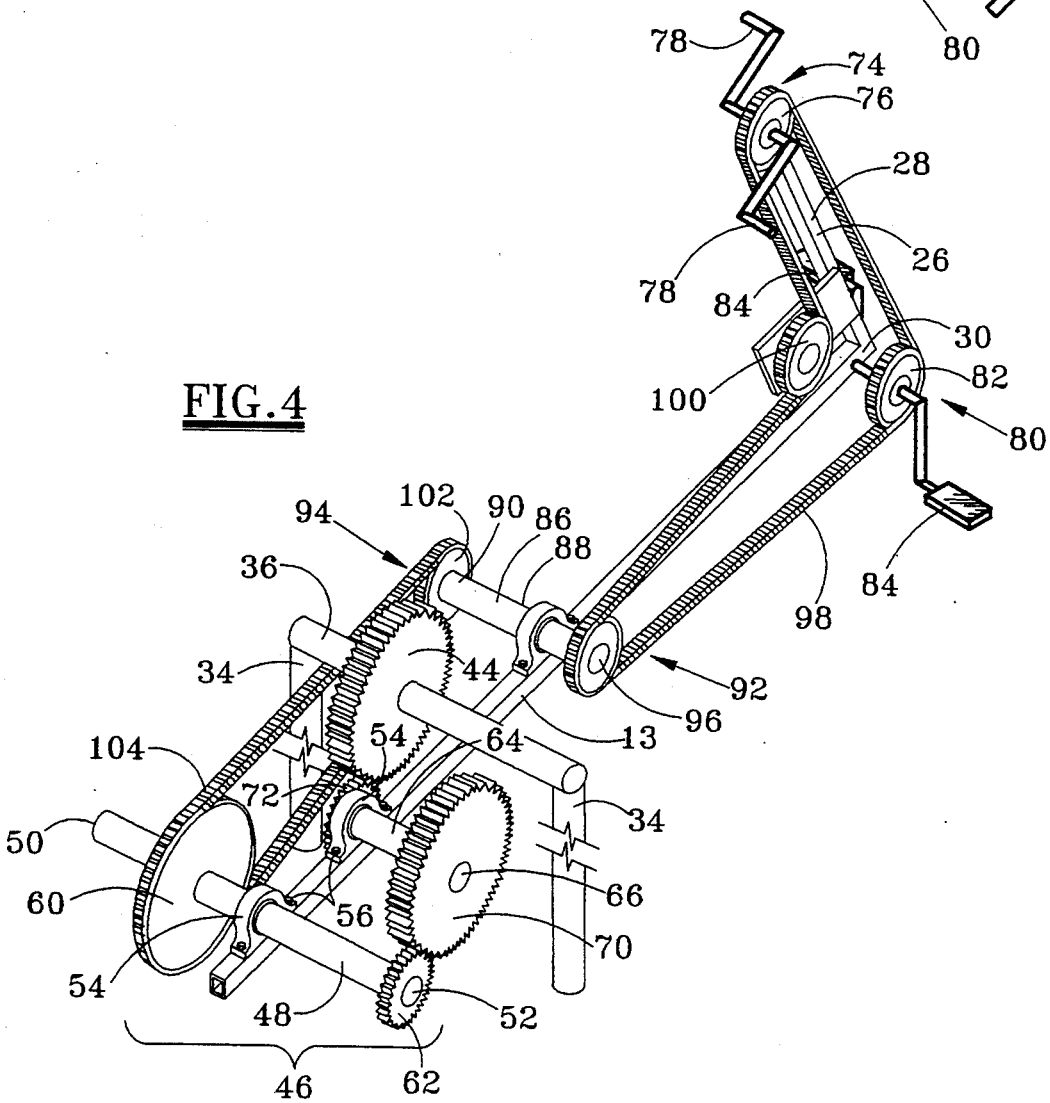
FIG. 4 is a perspective view of the rotation mechanism of the present invention illustrating the first drive mechanism, the second drive mechanism and an alternate embodiment frame support structure of the rotatable exercise apparatus of FIG. 3.

Referring now to FIGS. 3–5, a multi-geared rotation mechanism 46 is mounted to the main frame member 13 and one or more secondary frame members 15, adjacent to the pivot end 16 of the rotatable frame 12, to facilitate rotation of the rotatable frame 12 about the fixed primary gear 44.

The multi-geared rotation mechanism 46 is comprised of a first rotatable shaft 48, having a first end 50 and a second end 52 and a second rotatable shaft 64 having a first end 66 and a second end 68 and a plurality of gears 62, 70, and 72. The first rotatable shaft 48 and second rotatable shaft 64 are disposed within a bearing means 54 and said bearing means 54 is affixed to the main frame member 13 and one or more secondary frame members 15 via one or more bearing brackets 56 being engaged to the main frame member 13 using conventional bolts and nuts 58.

The multi-geared rotation mechanism 46 further includes a first driven sprocket 60 which is mounted to the first end 50 of the first rotatable shaft 48. A first drive gear 62 is mounted to the second end 52 of the first rotatable shaft 48.

A first driven gear 70 is mounted to said first end 66 of said second rotatable shaft 64, wherein said first driven gear 70 is mechanically engaged to said first drive gear 62. Rotational motion is imparted from the first drive gear 62 to the first driven gear 70. The second rotatable shaft 64 also includes a second drive gear 72 mounted adjacent to the second end 68 of the second rotatable shaft 64. The second drive gear 72 is mounted to the second rotatable shaft 64 such that it mechanically engages the primary gear 44. The second drive gear 72 mechanically engages and rotates about the primary gear 44, such that the rotatable frame 12 makes a complete 360 degree rotation about the upper fixed horizontal member 36.

Referring now to FIGS. 3–7 the rotatable exercise apparatus further includes a first pedal means 74 mounted to the first end 28 of the brace 26. The first pedal means 74 is designed to exercise the user's arms. The first pedal means 74 is comprised of a second sprocket 76 and two opposite extending, opposing pedals 78 formed to comfortably adapt to the user's arms.

A second pedal means 80 is affixed to the second end 30 of brace 26 for exercising the user's legs. The second pedal means 80 is comprised of a third sprocket 82 and two opposite extending, opposing pedals 84 formed to comfortably adapt to the user's legs. The user creates rotational energy used to rotate the frame 12 by simultaneously rotating the first pedal means 74 and second pedal means 80.

A main drive shaft 86, having a first end 88 and a second end 90, is also disposed within a bearing means 54 and mounted to the main frame member 13 and one or more secondary frame members 15 via one or more bearing brackets 56 and conventional fasteners 58.

The main drive shaft 86 transfers the rotational energy created by the first pedal means 74 and the second pedal means 80 to the rotation mechanism 46 using a first drive mechanism 92 and second drive mechanism 94.

The first drive mechanism 92 includes a fourth sprocket 96 and a first drive chain 98. The fourth sprocket 96 is mounted to the first end 88 of the main drive shaft 86. The First drive chain 98 is engaged to the first pedal means 74, the second pedal means 80, a tension sprocket 100 and the fourth sprocket 96 to impart the rotational energy created by the first pedal means 74 and second pedal means 80 to the main drive shaft 86. The tension sprocket 100 is mounted to the peripheral end 18 of the main frame member 13 to create and maintain tension on the first drive chain 98.

The second drive mechanism 94 includes a fifth sprocket 102 and a second drive chain 104. The fifth sprocket 102 is mounted to the second end 90 of the main drive shaft 86. The second drive chain 104 is engaged to the first sprocket 60 and the fifth sprocket 102 to impart the rotational energy from the main drive shaft 86 to the rotation mechanism 46 which rotates the rotatable frame 12 around the fixed primary gear 44.

The frame support structure 14 elevates the rotatable frame 12 above the ground such that the user can, while secured within the user support 19, safely rotate a full 360 degrees while engaging the first pedal means 74 and second pedal means 80.

The rotational exercise apparatus rotates the user while offsetting the user's center of gravity from the center of rotation. The offsetting of the user's center of gravity CG from the center of rotation CR strenuously exercises the muscles of the user's upper body, stomach, neck, back and sides in that the user exerts a maximum amount of strength in exercising these muscles, while completing rotations.

Figure 8:
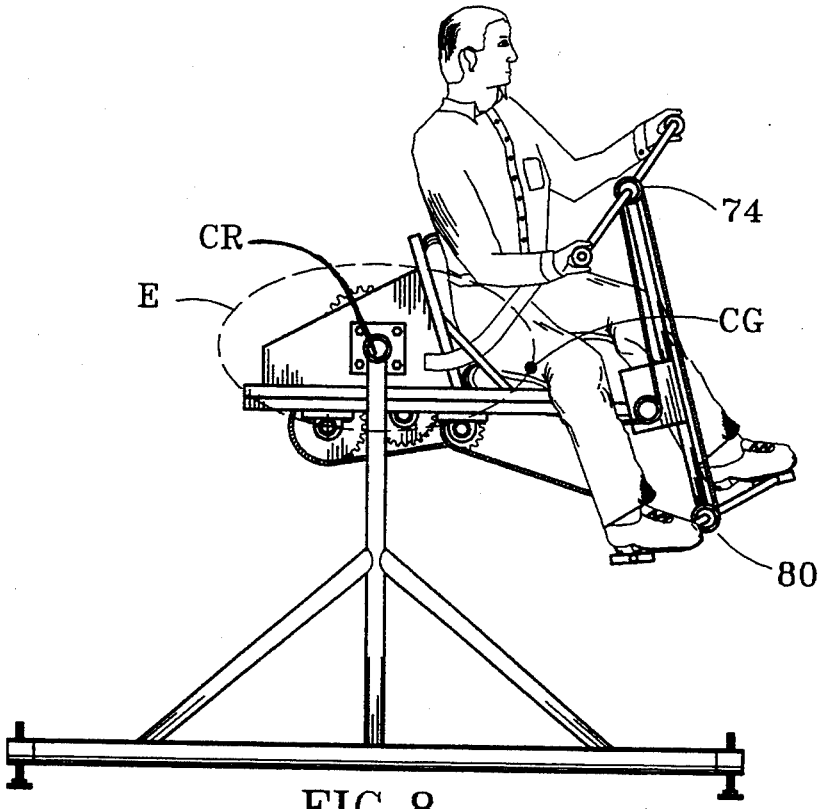
FIG. 8 is a side view of the rotational exercise apparatus of FIG. 1, illustrating a user in a position to begin operating a rotatable exercise apparatus as taught by the present invention.

Referring now to FIGS. 8–11, the rotational motion of the rotatable exercise apparatus 10 and the elliptical motion E of the user's center of gravity CG with respect to the user's center of rotation CR are illustrated. FIG. 8 illustrates the beginning position, wherein the user is sitting upright in the seat portion 20. The user's center of gravity CG is offset a maximum distance from the user's center of rotation CR. As the user begins to engage the first pedal means 74 and second pedal means 80, the rotatable frame 12 begins to rotate. As illustrated in FIG. 8, the user's arm and leg muscles are working in compression.

Figure 9:
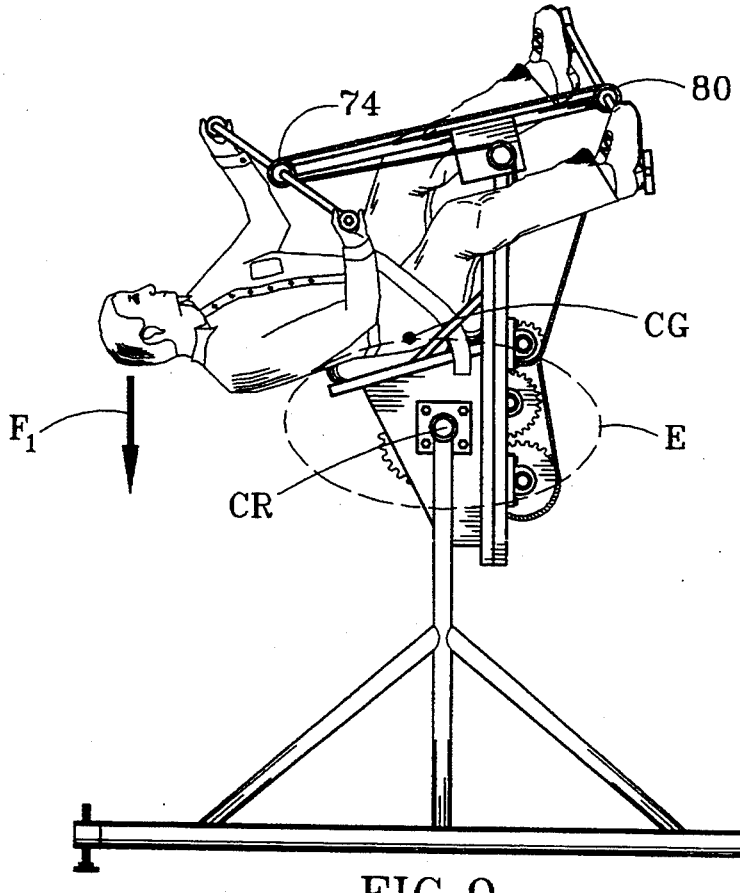
FIG. 9 is a side view of the rotational exercise apparatus of FIG. 1, illustrating the rotational motion of the present invention.

For convenience sake, rotation in FIG. 9 is illustrated as backward rotation, however the rotational exercise apparatus 10 could rotate in the forward direction just as easily. For an optimum work out, it is advantageous to alternate rotation in both clockwise and counterclockwise directions.

In FIG. 9, the work performed by the arm and leg muscles is lessened and the work performed by the user's stomach and forward neck muscles increases. The user's head experiences a first downward gravitational force $F_1$. The first downward gravitational force $F_1$ produces stress on the user's stomach and neck muscles, which results in exercising the stomach and neck muscles. The user's center of gravity CG is located a minimum distance away from the user's center of rotation CR.

Figure 10:
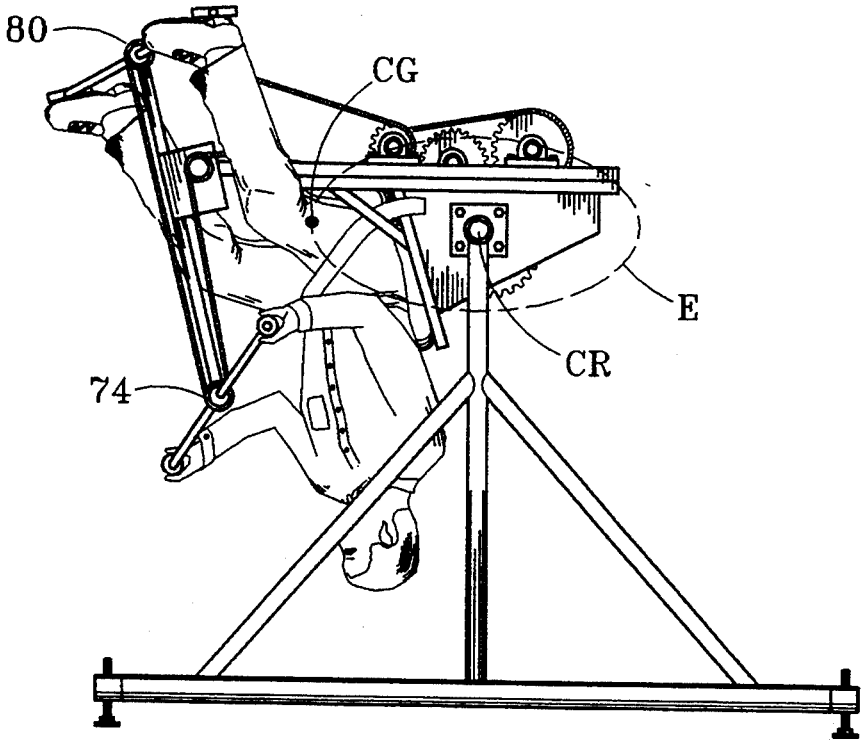
FIG. 10 is a side view of the rotational exercise apparatus of FIG. 1, illustrating the rotational motion of the present invention.

As illustrated in FIG. 10, the user is inverted while rotating. The rotation in FIG. 10 adds increased stress to the user's stomach and neck muscles and the arm and leg muscles are now working in tension. The user's center of gravity CG is at a maximum offset distance from the user's center of rotation CR.

Figure 11:
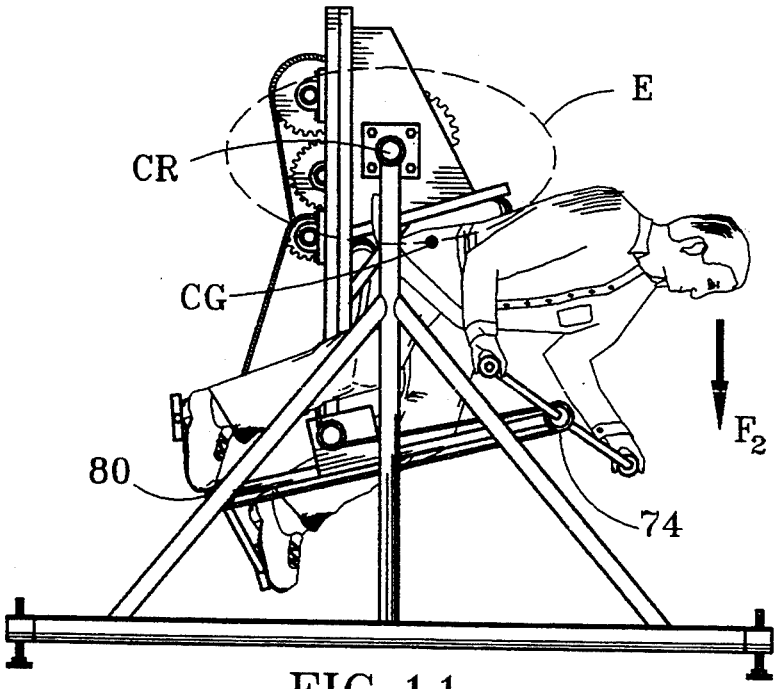
FIG. 11 is a side view of the rotational exercise apparatus of FIG. 1, illustrating the rotational motion of the present invention.

The rotation in FIG. 11 illustrates the recovery from the inverted position illustrated in FIG. 10. The user's arm and leg muscles experience reduced tension, however the user's back, shoulders and rear neck are stressed due to a second downward gravitational force $F_2$ applied to the user's head. The user's center of gravity CG is again at a minimum distance from the user's center of rotation CR. As the user approaches the upright position illustrated in FIG. 8, the stress is increased on the user's back, shoulders and rear neck. As illustrated in FIGS. 8-11, the user's center of gravity CG rotates about the user's center of rotation CR in an elliptical manner E.

The resistance used in the present invention is a function of the user's body weight. The greater the body weight of the user, the greater the exercise resistance will be experienced by the user. The user can easily reduce the resistance needed to effect rotation when using the present invention, without reducing the user's body weight. The user can easily replace the first sprocket 60 with an alternate sprocket (not shown) having a smaller diameter to reduce the resistance. Changing the first driven sprocket 60 is a relatively easy task to accomplish. Increasing the resistance of the present invention can be accomplished without increasing the user's weight, by replacing the first sprocket 60 with an alternate sprocket (not shown) having a greater diameter, the resistance can be increased. By varying the sprocket size of the first sprocket 60, the amount of resistance can vary between 200:1 to 5:1 to provide a strenuous, yet low impact, complete body work out, in a single exercise apparatus of equipment. When the diameter of the first sprocket 60 is reduced the speed of the rotatable exercise apparatus 10, is increased. When the diameter of the first sprocket 60 is increased the speed of the rotatable exercise apparatus 10, is decreased.

It will be appreciated that these and other embodiments may be provided which rotate a user while simultaneously exercising the user's arms, legs, back, sides and neck. Additional embodiments become readily apparent when the concept of the present invention is understood as described here and above. Having described the invention above, various modifications of the techniques, procedures, material and equipment will be apparent skilled in the art. It is intended that all such variations within the scope and the spirit of the appended be embraced thereby.

What is claimed is:

1. A rotatable exercise apparatus, for simultaneously providing strenuous exercise to the user's arms, legs, stomach, back, sides and neck, comprising:

a rotatable frame including a first pivot end and a second peripheral end; at least one secondary frame member in working association with said rotatable frame; a linearly extended brace having a first end and a second end; and a fixed, user support, the brace and the fixed, user support being mounted to the second peripheral end;

a support structure having a primary gear fixedly mounted thereto and means to affix said rotatable frame to said support structure, said support structure being engaged to the first pivot end of said rotatable frame; and a means for rotating the user in an inversional 360° vertical plane, said means for rotating including a rotation mechanism mounted to said rotatable frame, said rotation mechanism being mounted in mechanical engagement to and rotatable about the primary gear, said means for rotating further including a first pedal means mounted to the rotatable frame for use by the user's arms to cream energy for rotating the user; a second pedal means mounted to the rotatable frame for use by the user's legs to create energy for rotating the user; a main drive shaft, having a first end and a second end, the main drive shaft being mounted to said rotatable frame; a first drive mechanism engaged to the first and second pedal means and the main drive shaft, wherein the rotational energy created by the first and second pedal means is transferred through the first drive mechanism to rotate the main drive shaft; a tension sprocket mounted to said rotatable frame for maintaining tension on the first drive mechanism; and a second drive mechanism engaged to said rotation mechanism and the main drive shaft wherein rotational energy is transferred from the main drive shaft through the second drive mechanism to said rotation mechanism, to rotate said frame about the primary gear.

2. The rotatable exercise apparatus for simultaneously providing strenuous exercise to the user's arms, legs, stomach, back, sides and neck, as defined in claim 1, wherein the brace is mounted generally perpendicular to said rotatable frame.

3. The rotatable exercise apparatus for simultaneously providing strenuous exercise to the user's arms, legs, stomach, back, sides and neck, as defined in claim 2, wherein the support structure elevates the rotatable frame such that the user, while operating the rotatable exercise apparatus, can safely rotate said rotatable frame in the absence of contacting the ground.

4. The rotatable exercise apparatus for simultaneously providing strenuous exercise to the user's arms, legs, stomach, back, sides and neck, as defined in claim 3, wherein the longitudinal axis of the primary gear is the user's center of rotation about which said rotatable frame rotates.

5. The rotatable exercise apparatus for simultaneous providing strenuous exercise to the user's arms, legs, stomach, back, sides and neck, as defined in claim 4, wherein the rotation mechanism further comprises a multi-geared rotation mechanism.

6. The rotatable exercise apparatus for simultaneously providing strenuous exercise to the user's arms, less, stomach, back, sides and neck, as defined in claim 5, wherein the multi-geared rotation mechanism comprises:

a first rotatable shaft, having a first end and second end, said first rotatable shaft being rotatably secured within a bearing means, wherein said bearing means are secured within a coupling means, wherein said coupling means is mounted to said frame;

a first driven sprocket mounted to the first end of said first rotatable shaft, wherein said second drive mechanism rotatably engages said first driven sprocket to rotate said first driven sprocket and said first rotatable shaft;

a first drive gear mounted to the second end of said first rotatable shaft;

a second rotatable shaft, having a first end and a second end, said second rotatable shaft being rotatably secured within a bearing means, wherein said bearing means are secured within a coupling means, wherein said coupling means is mounted to said frame;

a first driven gear mounted to the first end of said second rotatable shaft, said first driven gear is mechanically engaged to said first drive gear, wherein rotation of the first rotatable shaft and first drive gear initiates instantaneous rotation of the first driven gear and second rotatable shaft; and a second drive gear mounted to the second end of said second rotatable shaft, said second drive gear mechanically engages said primary gear, wherein rotation of said second rotatable drive shaft causes said second drive gear and said rotatable frame to rotate about said primary gear and said horizontal member.

7. The rotatable exercise apparatus for simultaneously providing strenuous exercise to the user's arms, legs, stomach, back, sides and neck, as defined in claim 6, wherein said first pedal means includes a second sprocket and two opposite extending, opposing pedals formed to comfortably adapt to the user's arms.

8. The rotatable exercise apparatus for simultaneously providing strenuous exercise to the user's arms, legs, stomach, hack, sides and neck, as defined in claim 7, wherein said second pedal means includes a third sprocket and two opposite extending, opposing pedals formed to comfortably adapt to the user's legs.

9. The rotatable exercise apparatus for simultaneously providing strenuous exercise to the user's arms, legs, stomach, back, sides and neck, as defined in claim 9, said first drive mechanism includes a fourth sprocket mounted to the first end of said main drive shaft and a first drive chain, wherein the fourth sprocket and first drive chain are driven by the rotational movement of the first pedal means and the second pedal means.

10. The rotatable exercise apparatus for simultaneously providing strenuous exercise to the user's arms, legs, stomach, back, sides and neck, as defined in claim 9, said second drive mechanism including a fifth sprocket mounted to the second end of said main drive shaft and a first driven chain engaging said fifth sprocket and said first driven sprocket of said rotation mechanism, wherein rotation of said main drive shaft rotates said fifth sprocket and first driven chain, to rotate said rotation mechanism.

11. The rotatable exercise apparatus for simultaneously providing strenuous exercise to the user's arms, legs, stomach, back, sides and neck, as defined in claim 10, wherein the support structure includes a height adjusting means for adjusting the height of said support structure.

12. The rotatable exercise apparatus for simultaneously providing strenuous exercise to the user's arms, legs, stomach, back, sides and neck, as defined in claim 11, wherein the user's center of gravity rotates about the user's center of rotation in an elliptical manner.

* * * * *